US011085428B2

(12) United States Patent
Clev

(10) Patent No.: US 11,085,428 B2
(45) Date of Patent: Aug. 10, 2021

(54) HYDRAULIC DEVICE

(71) Applicant: KNORR-BREMSE SYSTEME FÜR SCHIENENFAHRZEUGE GMBH, Munich (DE)

(72) Inventor: Marcus Clev, Munich (DE)

(73) Assignee: KNORR-BREMSE SYSTEME FÜR SCHIENENFAHRZEUGE GMBH

( * ) Notice: Subject to any disclaimer, the term of this patent is extended or adjusted under 35 U.S.C. 154(b) by 0 days.

(21) Appl. No.: 15/773,906

(22) PCT Filed: Nov. 4, 2016

(86) PCT No.: PCT/EP2016/076706
§ 371 (c)(1),
(2) Date: May 4, 2018

(87) PCT Pub. No.: WO2017/077060
PCT Pub. Date: May 11, 2017

(65) Prior Publication Data

US 2018/0320674 A1 Nov. 8, 2018

(30) Foreign Application Priority Data

Nov. 6, 2015 (DE) ..... 102015119055.9

(51) Int. Cl.
*F04B 23/02* (2006.01)
*F04B 17/03* (2006.01)
(Continued)

(52) U.S. Cl.
CPC ..... *F04B 23/028* (2013.01); *F04B 17/03* (2013.01); *F04B 23/02* (2013.01); *F04B 23/025* (2013.01);
(Continued)

(58) Field of Classification Search
CPC ..... Y10T 137/87885; Y10T 137/86027; Y10T 137/85986; F04B 23/028; F04B 17/03;
(Continued)

(56) References Cited

U.S. PATENT DOCUMENTS 1,780,338 A * 11/1930 Canton ..... F04C 15/008 417/356
4,325,678 A * 4/1982 Kanamaru ..... F04B 49/20 415/122.1
(Continued)

FOREIGN PATENT DOCUMENTS

CN 202971420 U 6/2013
CN 204003691 U 12/2014
(Continued)

OTHER PUBLICATIONS

Machine Translation of DE19612582 retrieved Jun. 2019. (Year: 2019).*
(Continued)

*Primary Examiner* — Jessica Cahill
(74) *Attorney, Agent, or Firm* — Barnes & Thornburg LLP

(57) ABSTRACT

The invention relates to a hydraulic device for a rail vehicle including a tank region for a hydraulic fluid, a motor having a pump for pumping the hydraulic fluid, a hydraulic connection panel for providing hydraulic fluid paths and for holding hydraulic components, a control region for controlling the hydraulic components, and a housing. The tank region and the control region are arranged on opposite sides of the hydraulic connection panel. The motor is arranged together with the pump on one side of the hydraulic connection panel.

7 Claims, 7 Drawing Sheets

(51) Int. Cl.

| | |
|---|---|
| ***F15B 1/26*** | (2006.01) |
| ***F15B 13/08*** | (2006.01) |
| ***F04B 53/10*** | (2006.01) |
| ***F04C 11/00*** | (2006.01) |

(52) U.S. Cl.
CPC ..... *F15B 1/26* (2013.01); *F15B 13/0814* (2013.01); *F04B 53/1095* (2013.01); *F04C 11/008* (2013.01)

(58) Field of Classification Search
CPC ..... F04B 23/02; F04B 23/025; F04B 53/109; F15B 1/26; F15B 13/0814; F04C 11/008
See application file for complete search history.

(56) References Cited

U.S. PATENT DOCUMENTS

| | | | | |
|---|---|---|---|---|
| 4,384,828 | A * | 5/1983 | Rembold | F01C 21/08 417/356 |
| 5,219,276 | A * | 6/1993 | Metzner | F04C 2/102 417/356 |
| 5,330,104 | A * | 7/1994 | Marcus | F24F 1/0007 239/266 |
| 6,596,174 | B1 * | 7/2003 | Marcus | B01D 36/003 210/695 |
| 7,179,390 | B1 * | 2/2007 | Layton | B01D 36/00 123/196 A |
| 7,281,372 | B2 * | 10/2007 | Sakai | F15B 1/26 60/434 |
| 7,354,511 | B2 * | 4/2008 | Becker | B01D 35/0276 137/544 |
| 7,926,515 | B2 * | 4/2011 | Jung | F15B 1/26 137/884 |
| 8,438,845 | B2 * | 5/2013 | O'Brien, II | F15B 15/18 60/413 |
| 9,932,981 | B2 * | 4/2018 | Cosgrove | F01C 21/007 |
| 10,337,513 | B2 * | 7/2019 | Reul | F04B 53/08 |
| 2002/0060384 | A1 | 4/2002 | Kazmeier et al. | |
| 2003/0047218 | A1 * | 3/2003 | Cook | F04B 23/021 137/565.19 |
| 2004/0136847 | A1 | 7/2004 | Arbogast et al. | |
| 2004/0187488 | A1 * | 9/2004 | Dantlgraber | B29C 45/17 60/325 |
| 2006/0000757 | A1 | 1/2006 | Becker et al. | |
| 2011/0173966 | A1 | 7/2011 | Harald et al. | |
| 2014/0285987 | A1 | 9/2014 | Nagashima et al. | |
| 2015/0110642 | A1 * | 4/2015 | Dahouk | F04D 7/04 417/16 |
| 2016/0245245 | A1 * | 8/2016 | Volker | F04B 53/16 |

FOREIGN PATENT DOCUMENTS

| | | | | |
|---|---|---|---|---|
| DE | 2748897 | A1 * | 5/1979 | F04B 53/00 |
| DE | 2748897 | A1 | 5/1979 | |
| DE | 19612582 | A1 | 10/1997 | |
| DE | 19612585 | A1 | 10/1997 | |
| DE | 10056929 | A1 | 5/2002 | |
| DE | 10249494 | A1 | 5/2004 | |
| DE | 102014203301 | A1 | 9/2014 | |
| EP | 1413757 | A2 | 4/2004 | |
| GB | 1399071 | A | 6/1975 | |

OTHER PUBLICATIONS

Machine Translation of DE2748897 from worldwide.espacenet.com retrieved Apr. 7, 2020. (Year: 2020).*

Machine Translation of DE2748897A1 retrieved from espacenet.com on Oct. 7, 2020/ (Year: 2020).*

International Preliminary Report on Patentability for International Patent Application No. PCT/EP2016/076706; dated Jan. 30, 2017.

Chinese Office Action corresponding to Chinese Application 201680077979, dated Mar. 4, 2019.

European Office Action corresponding to German Application 16 791 390.4, dated Jun. 14, 2019.

* cited by examiner

HYDRAULIC DEVICE

PRIORITY CLAIM

This patent application is a U.S. National Phase of International Patent Application No. PCT/EP2016/076706, filed Nov. 4, 2016, which claims priority to German Patent Application No. 10 2015 119 055.9, filed Nov. 6, 2015, the disclosure of which being incorporated herein by reference in their entireties.

FIELD

The present invention relates to a hydraulic device for a rail vehicle and especially to an optimized arrangement of a motor-pump unit in hydraulic devices for rail vehicles.

BACKGROUND

A hydraulic device is a hydraulic control and supply unit which provides a controlled or regulated hydraulic flow for various components of the corresponding rail vehicles. For example, controllable valves may be constructed in the hydraulic devices, which activate certain hydraulic lines specifically in order to produce a volume flow there, or also deactivate them, the control of the hydraulic devices possibly occurring via a vehicle control unit. Hydraulic devices generally consist of three main components: a control region with a control cover, a connection panel (control board) and a tank region with a tank for a hydraulic fluid. Moreover, a motor and a pump to pump the hydraulic fluid into the control board are usually coupled to the control board.

SUMMARY

Disclosed embodiments relate to a hydraulic device for a rail vehicle, wherein the hydraulic device comprises a tank region for a hydraulic fluid, a motor with a pump for pumping the hydraulic fluid, a hydraulic connection panel for providing hydraulic fluid paths and for holding hydraulic components, and a control region for controlling the hydraulic components. The tank region and the control region are arranged on opposite sides of the hydraulic connection panel, and the motor is arranged together with the pump on one side of the hydraulic connection panel.

By a fluid path is meant all hollow spaces through which a hydraulic fluid can be conducted. The mentioned hydraulic fluid paths encompass, on the one hand, hydraulic lines leading to the outside, but also fluid connections which are formed inside the hydraulic connection panel and provide for example a connection from the pump to a valve, for example. Furthermore, no housing need be present. If a housing is present, the hydraulic connection panel can be arranged in the housing, for example, such that it divides the housing into two separate regions (the tank region and the control region).

BRIEF DESCRIPTION OF FIGURES

Disclosed embodiments will be better comprehended by the following detailed description and the accompanying drawings of the different sample embodiments, although these should not be taken to mean that the disclosure is limited to the specific embodiments, but rather they serve only for clarification and comprehension.

DETAILED DESCRIPTION

In rail vehicles of newer design, such as street cars which are manufactured in a low-floor model, the available design space is increasingly scarce. Therefore, ever increasing demands are being placed on the size of the individual components which are to be accommodated in the rail vehicle. For this reason, there is a demand for reducing the size of the components, such as the hydraulic device, so that they can be arranged in a more space-saving manner in the dwindling design space. On the other hand, other or extra functions often need to be accommodated in the same or in a dwindling design space. Increasingly, conventional hydraulic devices are no longer meeting these requirements.

Figure 6:
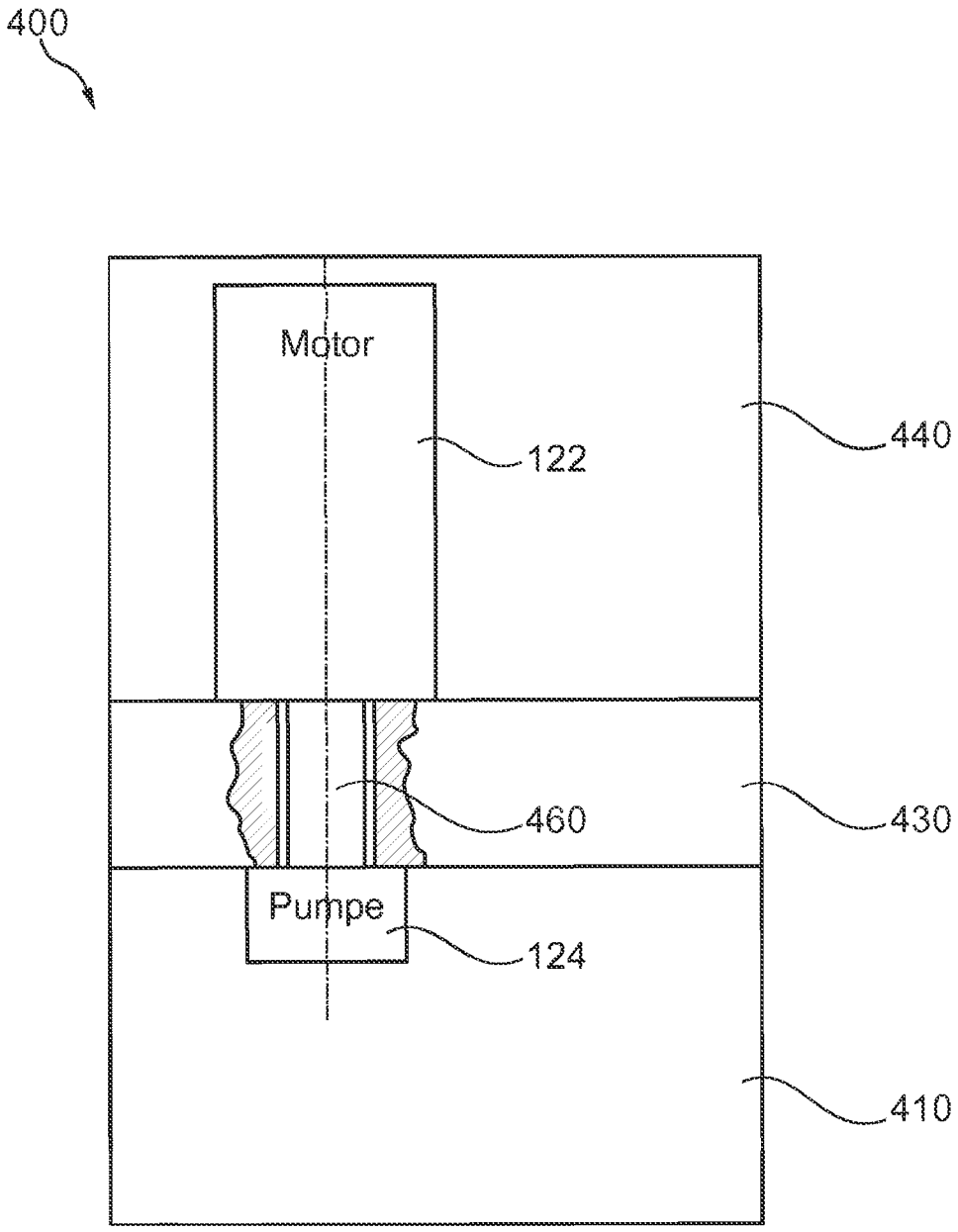
Fig. 6 PRIOR ART
FIG. 6 shows a first hydraulic device of conventional design.

FIG. 6 shows a first conventional hydraulic device for rail vehicles. It consists of a control region 440, a hydraulic connection panel 430 and a tank region 410. In the tank region 410 there is arranged a pump 124 and in the control region 440 there is arranged a motor 122. The motor 122 is connected via a lead-through bushing 460 through the hydraulic connection panel 430 to the pump 124 on the opposite side of the hydraulic connection panel 430. For example, the motor 122 and the pump 124 may have a common shaft, which is laid directly through the lead-through bushing 460. Alternatively, it is possible that the motor shaft 122 is coupled together with a corresponding shaft of the pump 124 via a coupling (not shown) in the lead-through bushing 460.

The pump 124 sucks in a liquid from the tank region 410, and pumps the hydraulic fluid through connection ducts (not shown in FIG. 6) into the hydraulic connection panel 430. Various electrical or hydraulic components may also be formed on the hydraulic connection panel 430, which are electrically actuated or electrically powered via the control region 440 (or via the tank region).

Figure 7:
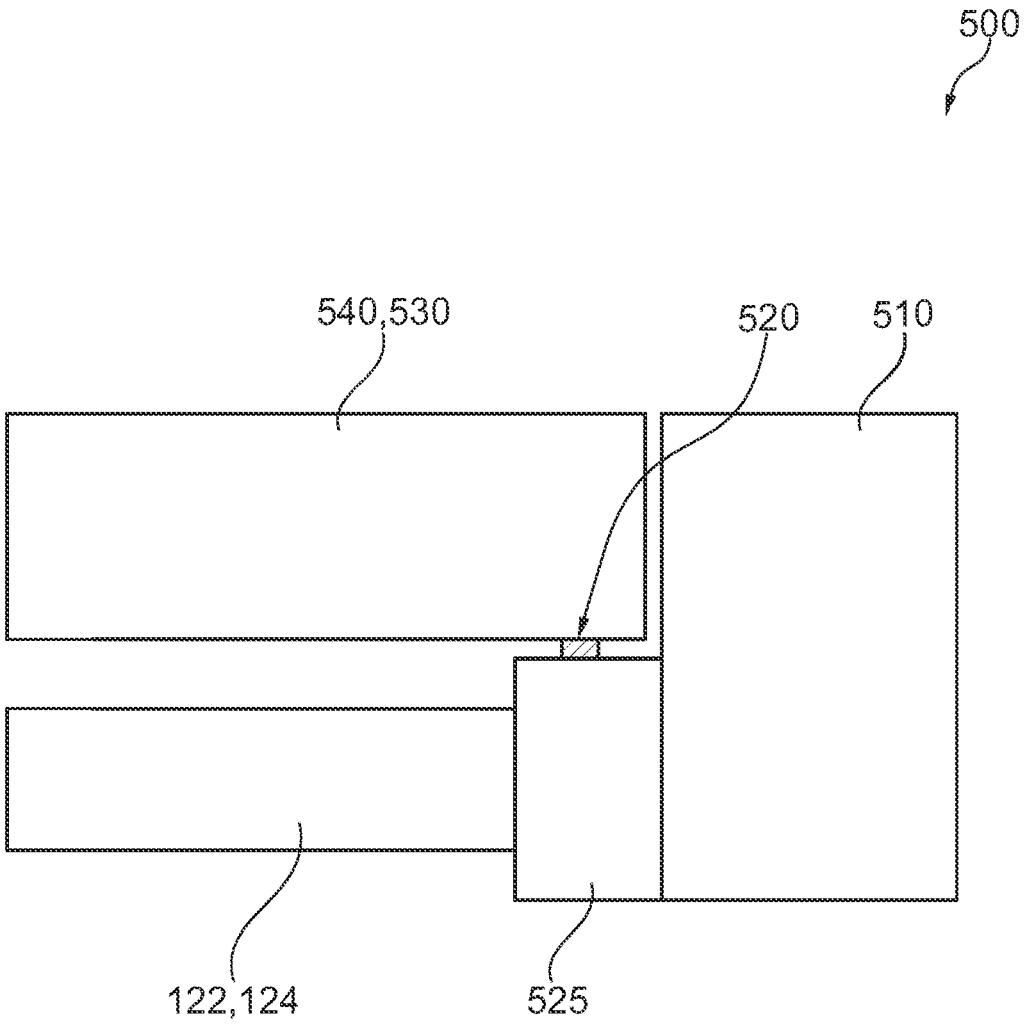
Fig. 7 PRIOR ART
FIG. 7 shows a second hydraulic device of conventional design.

FIG. 7 shows another conventional hydraulic device 500 with a tank region 510, a control unit 540 with integrated hydraulic connection panel 530 and an external motor-pump combination 122, 124, which is connected by at least one fluid duct 520 to the hydraulic connection panel 530 and to the tank region 510, in order to pump the hydraulic fluid from the tank region 510 into the hydraulic connection panel 530. Furthermore, a motor flange 525 is provided in order to support the motor-pump combination 122, 124.

The hydraulic devices shown have the following drawbacks. On the one hand, the motor-pump combination 122, 124 requires a lot of space on the control board 430. Therefore, fewer components can be arranged on the control board 430. Moreover, the lead-through bushing 460 of the motor and pump shaft requires an opening through the control board 430. This opening significantly reduces the control board cross section which can be used for the interconnecting of the components and results in costly designs for the connection boreholes between the control board 430 and the mounted components (not shown in FIGS. 6 and 7). In the special hydraulic device shown in FIG. 7, although a separation is provided between the control board 530 and the fastening of the motor-pump combination 122, 124, they require their own motor flange 525 and connection elements 520 for conveying the volume flow from the motor flange 525 to the control board 540, 530.

Hence, there is a need for hydraulic devices for rail vehicles which make it possible either to reduce the design size or to accommodate extra functions in the same design space.

As discussed above, disclosed embodiments relate to a hydraulic device for a rail vehicle, wherein the hydraulic device comprises a tank region for a hydraulic fluid, a motor with a pump for pumping the hydraulic fluid, a hydraulic connection panel for providing hydraulic fluid paths and for holding hydraulic components, and a control region for controlling the hydraulic components. The tank region and the control region are arranged on opposite sides of the hydraulic connection panel, and the motor is arranged together with the pump on one side of the hydraulic connection panel.

By a fluid path is meant all hollow spaces through which a hydraulic fluid can be conducted. The mentioned hydraulic fluid paths encompass, on the one hand, hydraulic lines leading to the outside, but also fluid connections which are formed inside the hydraulic connection panel and provide for example a connection from the pump to a valve, for example. Furthermore, no housing need be present. If a housing is present, the hydraulic connection panel can be arranged in the housing, for example, such that it divides the housing into two separate regions (the tank region and the control region).

The aforementioned technical problem is solved by the disclosed embodiments in that a hydraulic control and supply unit (hydraulic device) is created which has the identical functionality as compared to the conventional hydraulic devices, yet which, when implemented, reduces the required installation space or which, when implemented, enables more functions to be realized in the installation space.

In other exemplary embodiments, the hydraulic components comprise at least one valve and/or at least one sensor, which are electrically controllable. The control region may be designed as a cover and comprise a connector unit. The control region may furthermore comprise an electrical interconnection which interconnects the electrically controllable hydraulic components with the connector unit, so that the hydraulic components are controllable from outside the housing.

In other exemplary embodiments, the pump is arranged between the motor and the hydraulic connection panel. Optionally, the motor can also be arranged between the pump and the hydraulic connection panel. One benefit of the first embodiment is that the hydraulic fluid can be pumped directly from the pump into the hydraulic connection panel, without needing additional fluid lines. One benefit of the second embodiment is that the motor is given a secure support by the hydraulic connection panel, so that a mechanically more stable design can be achieved, especially when the motor is larger than the pump.

In other exemplary embodiments, the pump and the motor comprise a common rotation shaft or two rotation shafts coupled together, wherein the rotation shaft(s) is/are separated from the hydraulic connection panel. This means, in particular, that the rotation shaft of the pump and/or the rotation shaft of the motor are not coupled to the hydraulic connection panel and thus also cannot directly transmit vibrations to the hydraulic connection panel. For example, an intermediate space is formed for this purpose between the rotation shaft or shafts, which suppresses the negative influences, for example, of vibrations on sensors or similar components.

In other exemplary embodiments, the pump is arranged together with the motor in the tank region. One benefit of this embodiment is that the motor together with the pump can be cooled by the fluid present in the tank. Furthermore, a very efficient volume utilization is achieved in this way, since the tank volume only needs to be increased enough to contain the volume of the combination of pump and motor.

In other exemplary embodiments, the tank region comprises a tank for storage of the hydraulic fluid and the pump is accommodated with the motor in the tank.

In other exemplary embodiments, the hydraulic device comprises a support structure for holding the motor and/or the pump. The support structure is supported in the control region or in the tank region and is coupled to the hydraulic connection panel. One benefit of this embodiment is that it becomes possible to attenuate the vibrations produced by the motor and/or the pump and not transmit them directly to the connection panel with the hydraulic components formed thereon. Furthermore, already existing structures can be utilized as the support structures. In other exemplary embodiments, the support structure is part of the tank region or part of the control region.

In other exemplary embodiments, the support structure is coupled to the hydraulic connection panel or the pump is connected by a line to the hydraulic connection panel.

In other exemplary embodiments, the tank region comprises a tank housing and the control region comprises a cover, wherein the support structure can be fastened to the tank housing or the cover.

In other exemplary embodiments, the pump is arranged in the tank region and the motor is fastened on an outer wall of the tank region. Optionally, the motor and the pump is fastened on the hydraulic connection panel next to the tank region.

Disclosed embodiments also relate to a hydraulic device for a rail vehicle with a tank region for a hydraulic fluid, a hydraulic connection panel for providing hydraulic fluid paths and for holding hydraulic components, and a control region for controlling the hydraulic components, wherein the tank region and the control region are arranged on opposite sides of the hydraulic connection panel. Furthermore, this hydraulic device comprises a pump for pumping the hydraulic fluid, which is situated in the tank region. Optionally, a possibility of fastening on the tank region is provided, in order to fasten a motor for operating the pump on an outer surface of the tank region.

Figure 1:
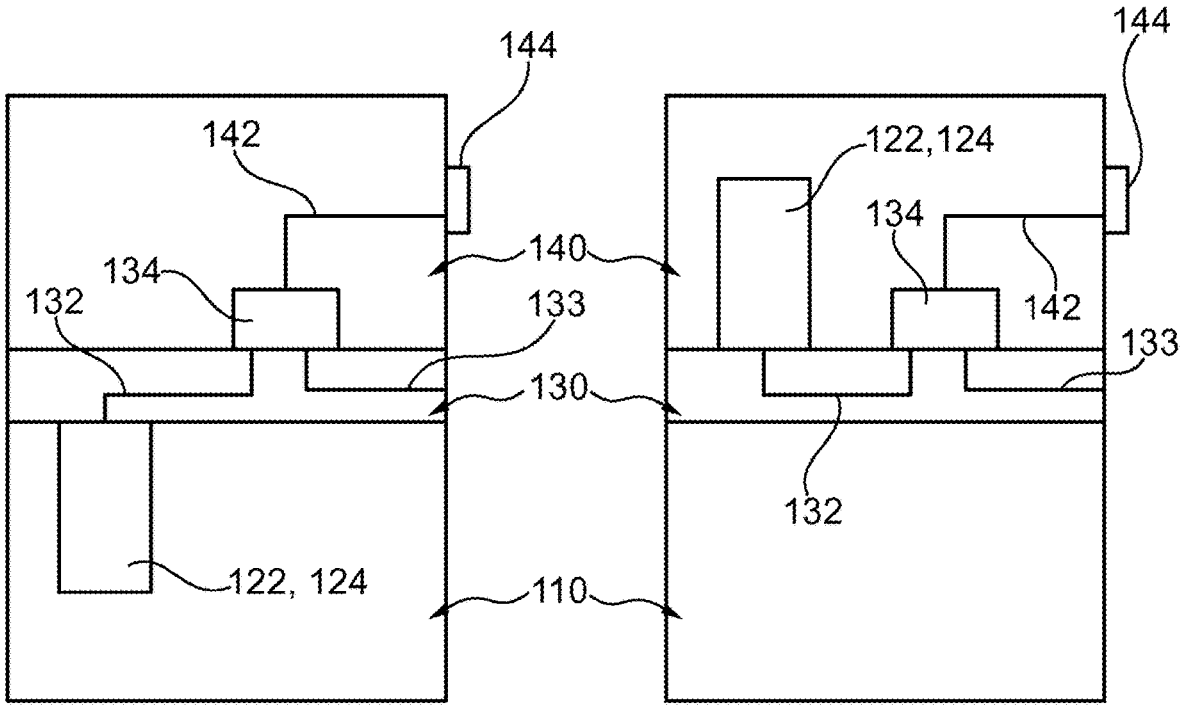
FIG. 1 shows a hydraulic device for a rail vehicle according to one sample embodiment.

Disclosed embodiments also relate to a rail vehicle with one of the above-described hydraulic devices. FIG. 1 shows a hydraulic device for a rail vehicle, wherein the hydraulic device comprises the following components: a tank region 110 for a hydraulic fluid (not shown), a motor 122 with a pump 124 for pumping the hydraulic fluid, a hydraulic connection panel 130 for providing hydraulic fluid paths 132, 133 and for holding hydraulic components 134, a control region 140 for controlling the hydraulic components 134 and a housing 150. In the housing 150 are accommodated the tank region 110, the hydraulic connection panel 130 and the control region 140, the tank region 110 and the control region 140 being arranged on opposite sides and the motor 122 being arranged together with the pump 124 on one side of the hydraulic connection panel 130.

On the left side of FIG. 1, the motor 122 is arranged together with the pump 124 in the tank region 110, while on the right side the motor 122 is arranged with the pump 124 in the control region 140.

The hydraulic components 134 may comprise valves and/or sensors, for example, which open or close hydraulic flow paths 132, 133 or perform measurements on the hydraulic fluid (for example, pressure measurements). The hydraulic flow paths 132, 133 may be internal flow paths 132 between the components on the hydraulic connection panel 130 or other hydraulic flow paths 133 coupled to an external hydraulic line (outside the housing). The valves may be, for example, electromagnetically controlled valves, which are connected by an electrical line 142 to a connector unit 144, the connector unit 144 making a connection between the interior region of the housing 150 and the outside region. For example, the hydraulic device may be electrically controlled by a control unit of the rail vehicle via the connector unit 144, for example in order to read out sensor data from the sensors or to control the valves via corresponding signals.

The hydraulic connection panel 130 for example divides the interior region of the housing 150 into two sections. In the one section there is accommodated the tank region 110, comprising in particular the tank itself, while in the other region is formed the control region 140. The motor 122 together with the pump 124 can be arranged, for example, directly in the tank (see left side of FIG. 1), so that the hydraulic fluid can flow around it. This affords the benefit that the hydraulic fluid provides a cooling for the motor 122 as well as the pump 124 at the same time. The accommodation of the motor 122 and the pump 124 in the tank region 110 furthermore affords the benefit that more room is available in the control region 140 for additional or other hydraulic or non-hydraulic components. However, the control region 140 may also be chosen to be correspondingly smaller. The additional space requirement in the tank region 110 additionally necessitated by installing the motor 122 and the pump 124 is only limited to the volume of the motor 122 and the volume of the pump 124 itself, so that an additional space requirement is reduced to a minimum. By moving the motor into the tank region, the height of the control cover can furthermore be reduced. The tank cover can be increased by this amount. Thus, the overall height of the device is not changed and the available oil volume in the tank can be kept almost constant.

Figure 2:
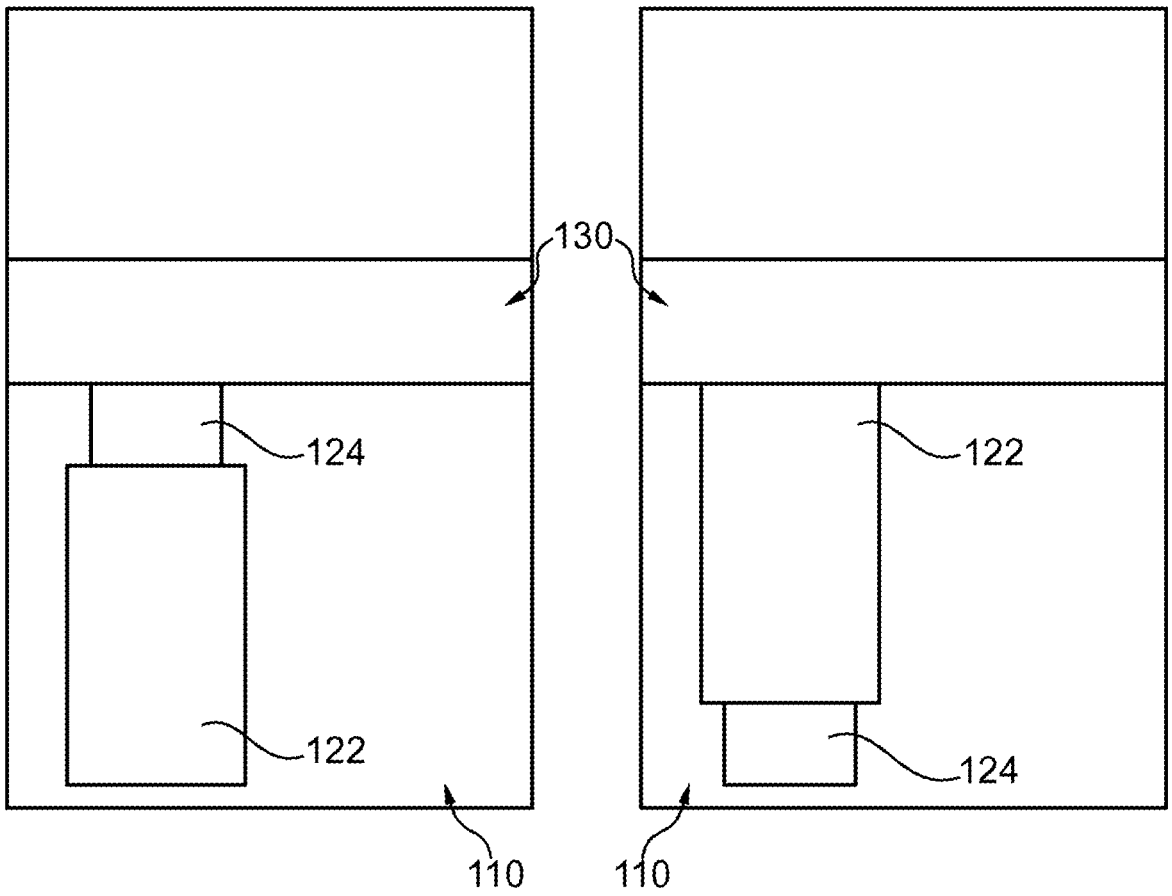
FIG. 2 shows further embodiments of the hydraulic device.

FIG. 2 shows sample embodiments in which the motor 122 and the pump 124 are accommodated in the tank region 110. There are two possibilities here: the pump 124 is arranged between the motor 122 and the hydraulic connection panel 130 (see left side of FIG. 2) or the motor 122 is arranged between the pump 124 and the hydraulic connection panel 130 (see right side of FIG. 2).

The sample embodiment on the left side of FIG. 2, where the pump 124 is directly coupled to the hydraulic connection panel 130, affords the benefit that the hydraulic flow paths which are formed in the hydraulic connection panel 130 can be supplied with the hydraulic fluid directly by the pump 124.

In the sample embodiment on the right side of FIG. 2, an additional hydraulic flow line is formed from the pump 124 to the hydraulic connection panel 130, although this is not shown on the right side of FIG. 2. However, this embodiment affords the benefit that the motor 122 is fastened directly to the hydraulic connection panel 130 and thus has a better support.

In both embodiments, the shaft which extends through the motor 122 and the pump 124 is not led into the hydraulic connection panel 130. In particular, an intermediate space may be present between the shaft and the hydraulic connection panel 130. Therefore, sample embodiments further afford the benefit that no additional holes or bores need to be made in the hydraulic connection panel 130, so that the entire volume of the hydraulic connection panel 130 is available to provide hydraulic flow paths.

Figure 3:
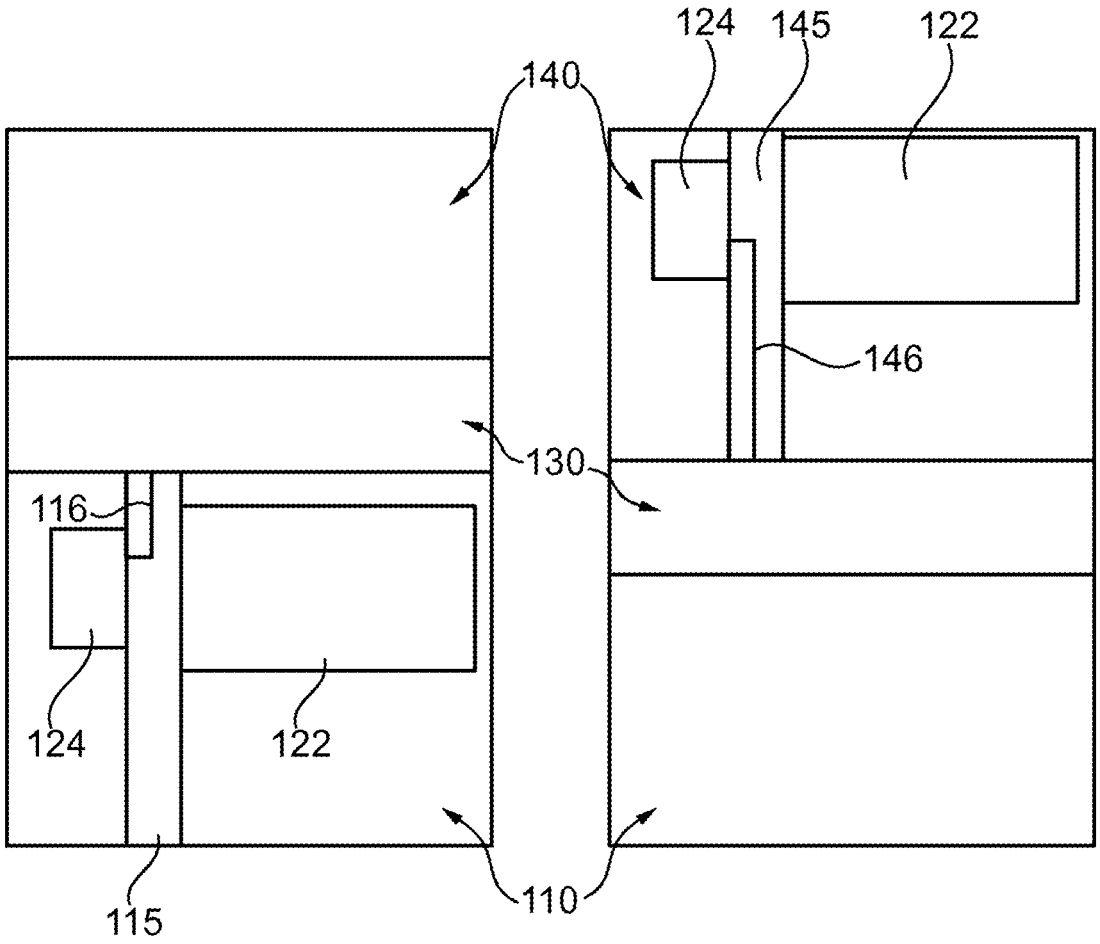
FIG. 3 shows sample embodiments of hydraulic devices with a support structure.

FIG. 3 shows further sample embodiments in which the motor 122 and the pump 124 are not coupled directly to the hydraulic connection panel 130, but instead are supported by a support structure 115, 145. The support structure 115, 145 may, for example, be a support structure 115 of the tank region 110 or a support structure 145 of the control region 140. On the left side of FIG. 3 is shown the sample embodiment where the support structure 115 is part of the tank region 110, so that the support structure 110 supports the motor 122 and the pump 124 in the tank region 110. Optionally, the support structure 115 may likewise provide a connection 116 to the hydraulic connection panel 130, in order to take the hydraulic fluid from the pump 124 to the hydraulic connection panel 130. Moreover, another solution may be used outside of the support structure for hydraulic connections (e.g., a pipe or hose connection, as shown in FIG. 4C).

In the sample embodiment on the right side of FIG. 3, the support structure 145 is part of the control region 140 and is supported for example by a control cover. In this sample embodiment, an additional hydraulic flow path 146 is formed from the pump 124 to the hydraulic connection panel 130. However, additional pipe or hose connections may also be formed in order to produce the hydraulic flow path. Moreover, a connection to the tank is formed, which is not shown in FIG. 3.

Figure 4:
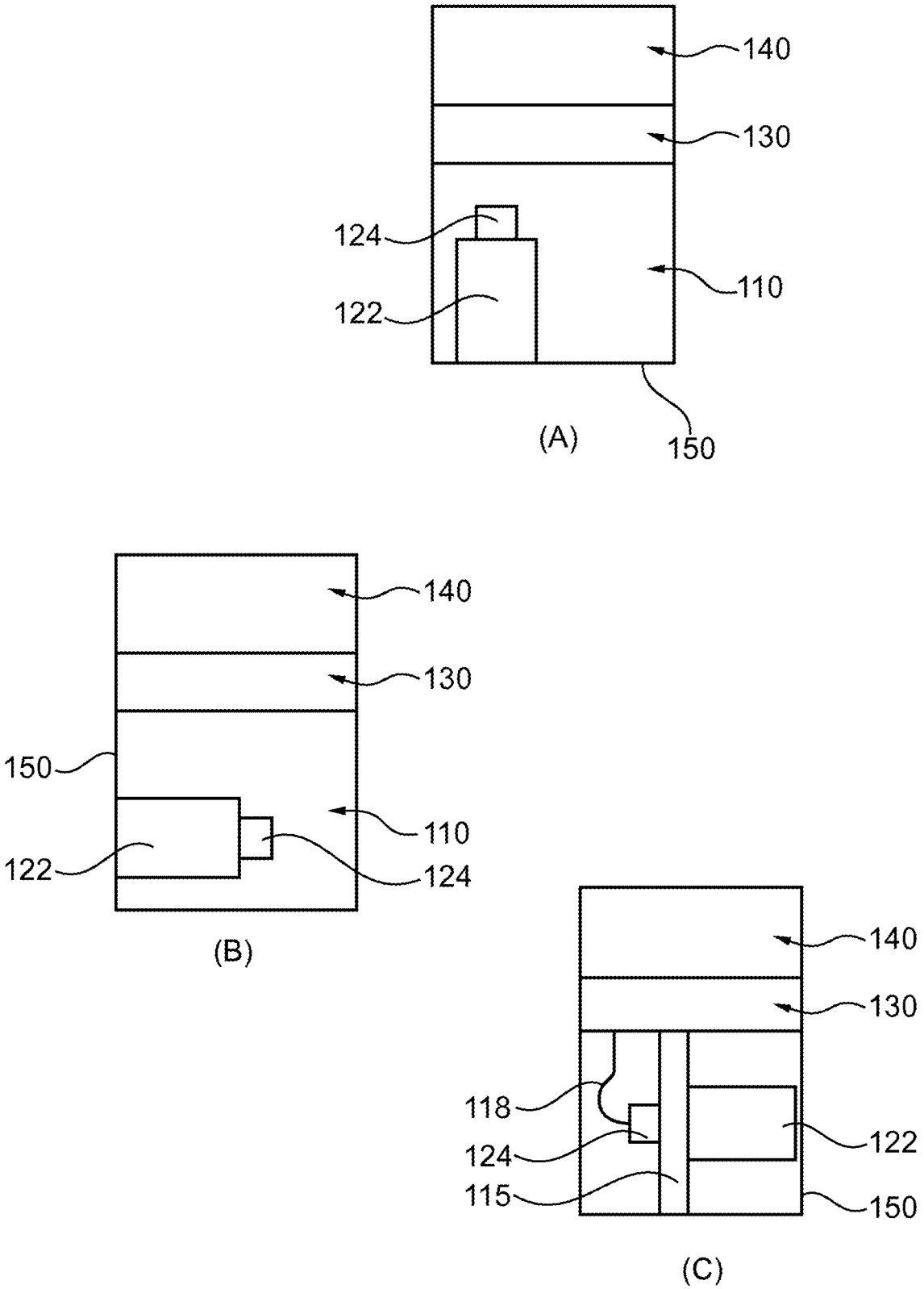
FIG. 4 shows sample embodiments in which the motor and the pump are arranged in various positions in the tank region.

FIG. 4 shows further sample embodiments in which the motor 122 and the pump 124 are arranged at different positions in the tank region 110.

In FIG. 4A, the tank region 110 comprises a housing 150, in which the tank is accommodated for example (not shown in the figure). In this sample embodiment, the motor 122 is fastened to the housing 150 and the pump 124 may accordingly be supported by the motor 122. Between the pump 124 and the hydraulic connection panel 130 is formed a line, for example, which cannot be seen in FIG. 4A.

FIG. 4B shows a further possibility of fastening the motor 122 and the pump 124 on a side wall of the housing 150 and not mounting them on a wall of the housing 150 opposite the hydraulic connection panel 130 (as in FIG. 4A).

FIG. 4C shows a sample embodiment in which the support structure 115 of the tank region 110 provides no hydraulic duct or flow path in order to pump the hydraulic fluid pumped by the pump 124 to the hydraulic connection panel 130. Instead, in this sample embodiment a fluid line 118 is formed as a connection between the pump 124 and the hydraulic connection panel 130. The hydraulic line 118 may be formed in the same way likewise in FIGS. 4A and 4B, even though it cannot be seen there. In all three sample embodiments of FIG. 4, the motor 122 and/or the pump 124 may be arranged in the tank or also alongside it. For example, the tank region 110 may have a cavity between the housing 150 and the fluid tank, which can accommodate the motor 122 and the pump 124.

Figure 5:
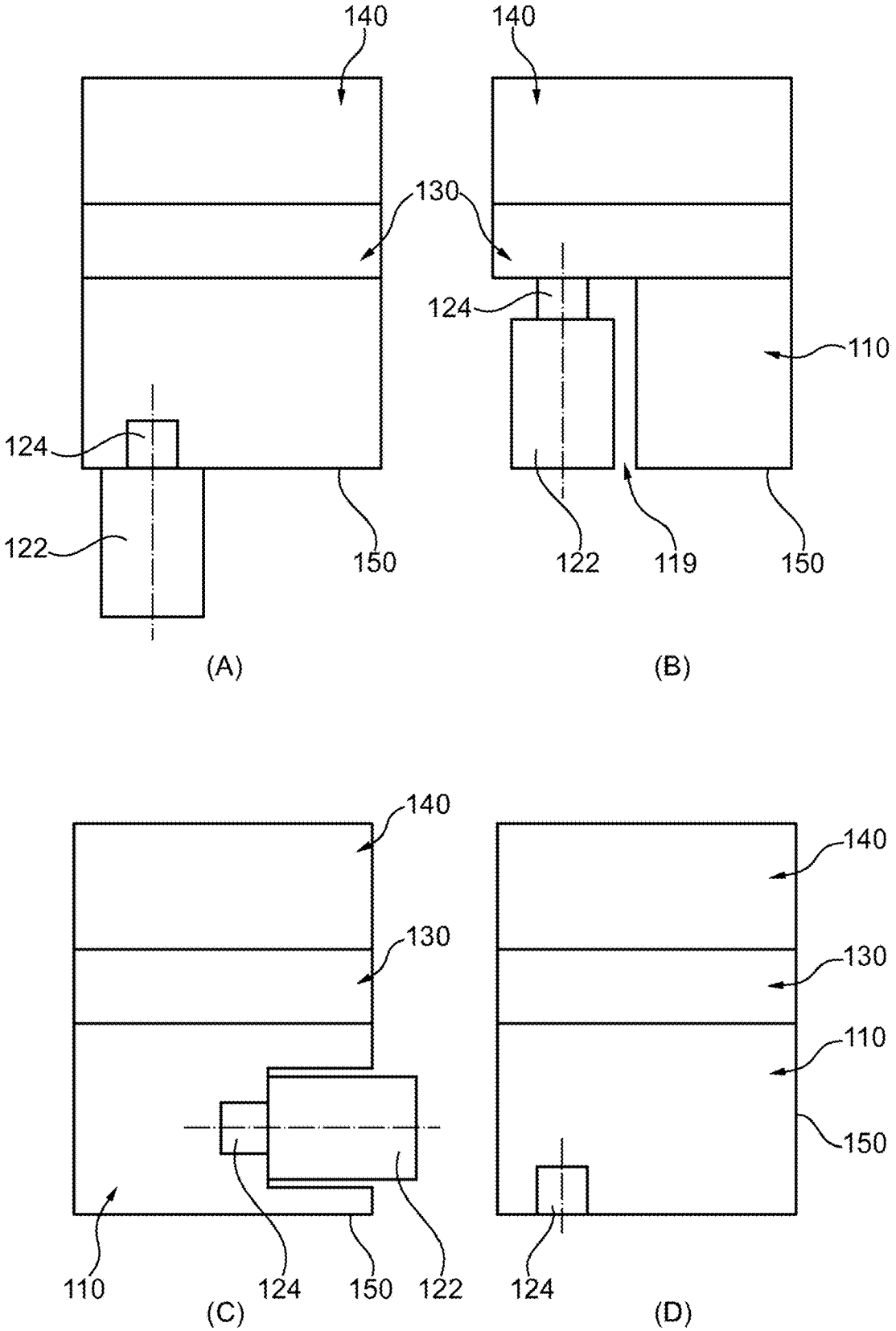
FIG. 5 shows sample embodiments in which the motor is arranged outside the tank region.

FIG. 5 shows further sample embodiments in which at least the motor 122 is arranged outside the housing 150 of the tank region 110.

In FIG. 5A, the motor 122 is fastened on an outer surface of the housing 150. For this purpose, a corresponding fastening possibility can be formed for example on the housing 150 of the tank region 110. The motor 122 once more is coupled to the pump 124, which in this sample embodiment is formed inside the housing 150 and may be located for example in the tank itself or in a corresponding cavity of the tank region 110.

FIG. 5B shows a sample embodiment in which the motor 122 together with the pump 124 is arranged next to the tank region 110, i.e. outside the housing 150, on the hydraulic connection panel 130. For example, an intermediate space 119 may be formed between the motor 122 and the housing 150.

FIG. 5C shows a sample embodiment in which the housing 150 of the tank region 110 has a recess, which can accommodate the motor 122. The motor 122 once again is coupled directly or via a coupling to the pump 124, which in this sample embodiment is fastened inside the housing 150, i.e. to a bottom of the recess. The recess for example may be chosen to be large enough so that it receives the motor 122 entirely or at least partially, so that when installed in the rail vehicle it does not stick out to the side or bottom (as can be seen, for example, in FIG. 5A).

In other sample embodiments the motor may likewise be fastened to a side wall of the housing (i.e., not opposite the hydraulic connection panel 130) on the housing 150.

Disclosed embodiments likewise pertain to a hydraulic device not having any motor 122, but only providing a fastening possibility of fastening the motor 122, for example, on an outer housing of the tank region 110.

Disclosed embodiments have the following benefits:

(a) The motor 122 and the pump 124 are connected and arranged on one side of the hydraulic connection panel 130 such that no opening is required through the hydraulic connection panel 130 (or a modification thereof).

(b) The motor 122 and the pump 124 are supported by a support structure 115, 145 as part of the control region 140 or the tank region 110 independently of the hydraulic connection panel 130, so that no separate support is required on the hydraulic connection panel 130, such as a motor flange.

(c) Disclosed embodiments furthermore afford the possibility of arranging the motor 122 together with the pump 124 in the oil volume of the tank 110 as well as outside the oil volume (but still in the tank region).

The features of the disclosed embodiments disclosed in the description, the claims, and the figures may be instrumental to the realization of the invention both individually and in any given combination.

LIST OF REFERENCE NUMBERS

110 Tank region
115,145 Support structure
122 Motor
124 Pump
130 Hydraulic connection panel
132,133 Fluid paths
134 Hydraulic components
140 Control region
144 Connector unit
150 Housing
410,510 Tank region of conventional design
440, 540 Control region of conventional design
430,530 Hydraulic connection panel of conventional design
520 Connection element
525 Motor flange

The invention claimed is:

1. A hydraulic device for a rail vehicle comprising:
a tank region for a hydraulic fluid, a motor with a pump for pumping the hydraulic fluid,
a hydraulic connection panel for providing hydraulic fluid paths and for holding hydraulic components,
and a control region comprising a connector unit and an electrical interconnection,
wherein the tank region and the control region comprising the connector unit and the electrical interconnection are arranged on opposite sides of the hydraulic connection panel,
wherein the motor is arranged together with the pump on one side of the hydraulic connection panel,
wherein the pump is arranged together with the motor in the tank region, the hydraulic device further comprising a holding structure that directly connects to each of the motor and the pump, the holding structure held in the tank region and coupled to the hydraulic connection panel, and
wherein the motor and the pump are held independently of the hydraulic connection panel by the holding structure,
wherein the tank region comprises a tank for storage of the hydraulic fluid and the pump is accommodated with the motor in the tank.

2. The hydraulic device of claim 1, wherein the hydraulic components comprise at least one valve and/or at least one sensor, which are electrically controllable.

3. The hydraulic device of claim 1, wherein the pump and the motor comprise a common shaft or two shafts coupled together, wherein the common rotation shaft or two shafts is/are separated from the hydraulic connection panel.

4. The hydraulic device of claim 1, wherein the holding structure is coupled to the hydraulic connection panel.

5. The hydraulic device of claim 1, wherein the tank region comprises a housing and the control region comprises a cover and the holding structure is fastened to the housing.

6. A hydraulic device for a rail vehicle, the hydraulic device comprising:
a tank region for a hydraulic fluid,
a hydraulic connection panel for providing hydraulic fluid paths and for holding hydraulic components, and
a control region comprising a connector unit and an electrical interconnection, wherein the device comprises: a pump for pumping the hydraulic fluid, which is situated in the tank region, and is fastenable in the tank region to fasten a motor on the same side of the connection panel as the tank region for operating the pump on an outer surface of the tank region, the device further comprising a holding structure that directly connects to each of the motor and the pump, the holding structure held in the tank region and coupled to the hydraulic connection panel, and
wherein the motor and the pump are held independently of the hydraulic connection panel by the holding structure,
wherein the tank region comprises a tank for storage of the hydraulic fluid and the pump is accommodated with the motor in the tank.

7. A rail vehicle with a hydraulic device that includes a tank region for a hydraulic fluid, a motor with a pump for pumping the hydraulic fluid, a hydraulic connection panel for providing hydraulic fluid paths and for holding hydraulic components, and a control region comprising a connector unit and an electrical interconnection, wherein the tank region and the control region comprising the connector unit and the electrical interconnection are arranged on opposite sides of the hydraulic connection panel, and wherein the motor is arranged together with the pump on one side of the hydraulic connection panel opposite the control region, a holding structure that directly connects to each of the motor and the pump, the holding structure held in the tank region and coupled to the hydraulic connection panel, and wherein the motor and the pump are held independently of the hydraulic connection panel by the holding structure, wherein the tank region comprises a tank for storage of the hydraulic fluid and the pump is accommodated with the motor in the tank.

* * * * *